United States Patent [19]

Burns

[11] Patent Number: 4,690,322

[45] Date of Patent: Sep. 1, 1987

[54] RESEALABLE ENVELOPE

[76] Inventor: Joseph E. Burns, 754 Chandler Rd., Gurnee, Ill. 60031

[21] Appl. No.: 926,359

[22] Filed: Oct. 31, 1986

[51] Int. Cl.[4] ..... B65D 27/06; B65D 27/16

[52] U.S. Cl. ..... 229/80; 383/86; 206/632

[58] Field of Search ..... 229/80; 383/86; 206/632, 813

[56] References Cited

U.S. PATENT DOCUMENTS

| | | | |
|---|---|---|---|
| 1,800,143 | 4/1931 | Hughes . | |
| 2,026,837 | 1/1936 | Kennedy, Jr. . | |
| 2,118,706 | 5/1938 | Heywood . | |
| 2,215,989 | 9/1940 | Wolf | 229/80 |
| 2,367,440 | 1/1945 | Schieman | 229/80 |
| 2,819,010 | 1/1958 | Amiguet . | |
| 3,070,280 | 12/1962 | Richmond . | |
| 3,151,803 | 10/1964 | Kaminski . | |
| 3,265,289 | 8/1966 | Hiersteiner . | |
| 3,310,225 | 3/1967 | Hoblit . | |
| 3,372,861 | 3/1968 | Johnson et al. | 229/80 |
| 3,702,171 | 11/1972 | Levine | 229/80 |
| 4,518,087 | 5/1985 | Goglio | 206/632 |
| 4,543,139 | 9/1985 | Freedman et al. | 383/86 |

*Primary Examiner*—Stephen P. Garbe

*Attorney, Agent, or Firm*—Neuman, Williams, Anderson & Olson

[57] ABSTRACT

A resealable envelope is provided which has a simple and inexpensive construction. This envelope includes two paper panels disposed in face-to-face relation with one panel having an extending portion to provide a sealing flap. A first plastic strip fixedly secured to the inner face of the flap, a second plastic strip fixedly secured to the outer surface of the panel which the flap engages to close the envelope, and a pressure sensitive contact adhesive applied by a removable tape to one of the plastic strips provide a seal for the envelope.

5 Claims, 6 Drawing Figures

FIG. 1
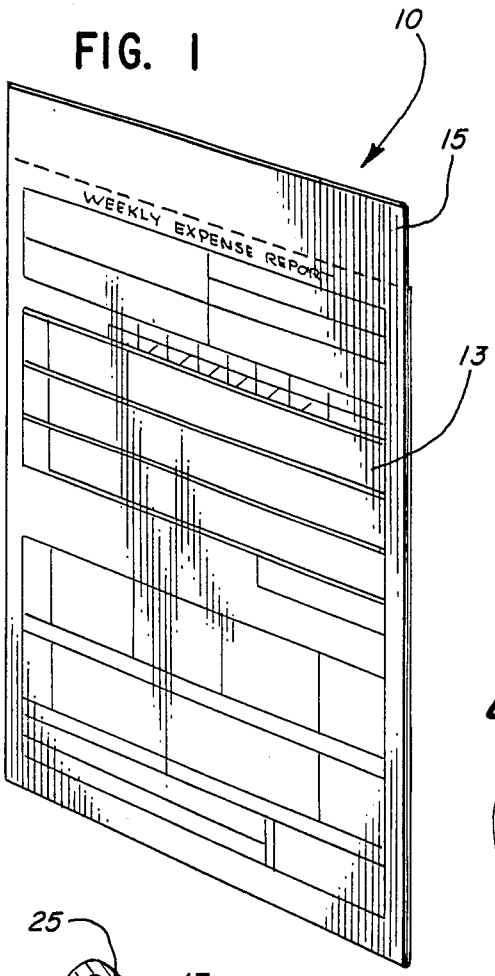
FIG. 2
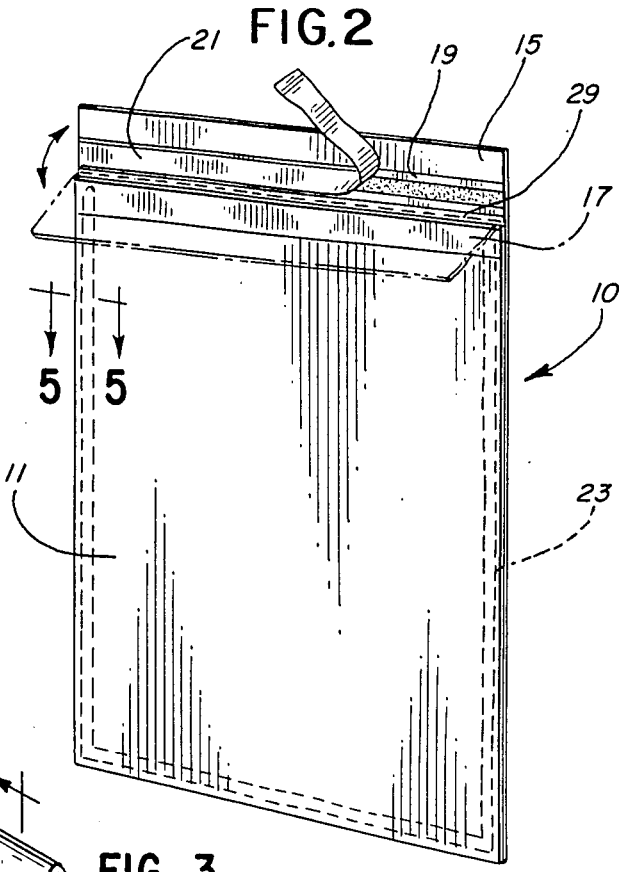
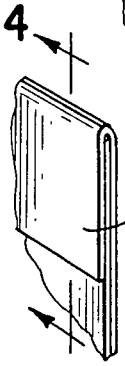
FIG. 3
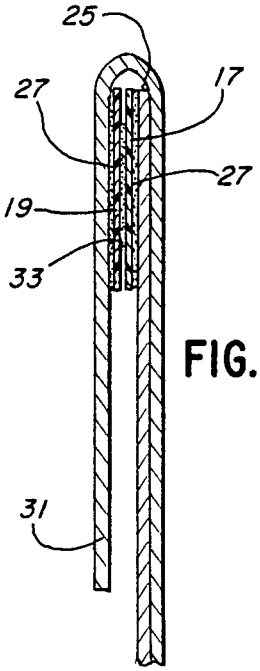
FIG. 4
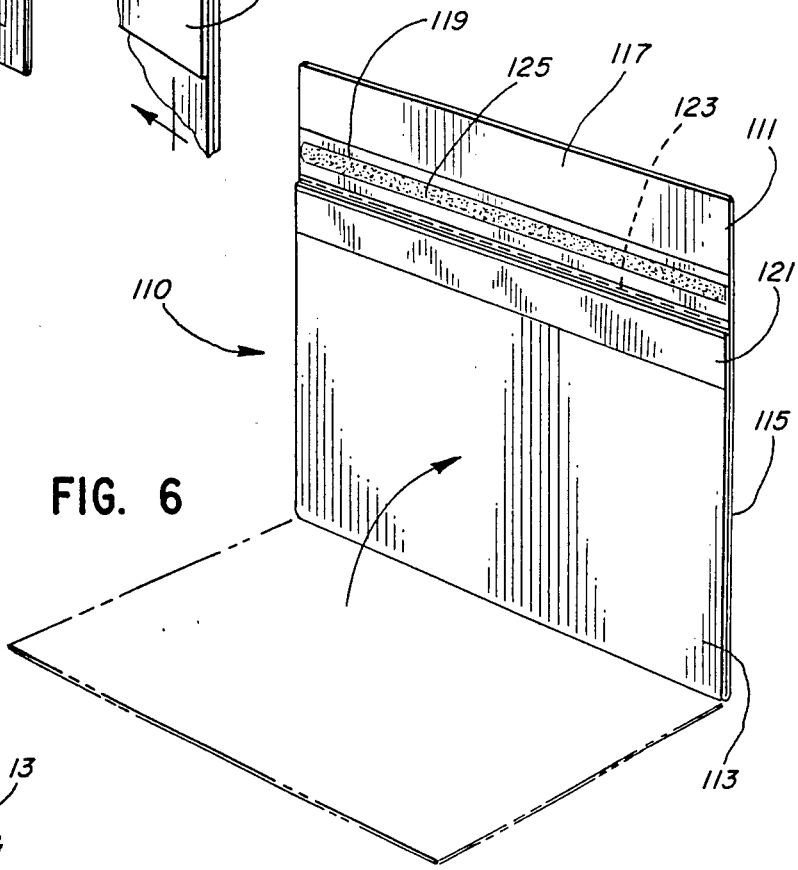
FIG. 6
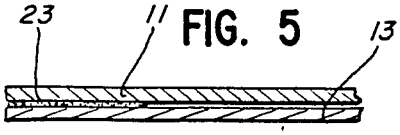
FIG. 5

RESEALABLE ENVELOPE

BACKGROUND OF THE INVENTION

1. Field of the Invention

The present invention generally relates to a resealable envelope, and more specifically to a resealable envelope having an improved seal.

2. Background of the Invention

Many business applications require the use of simple and inexpensive resealable envelopes. For example, instead of using unsightly and unreliable staples and clips to secure documents associated with a business report to the report, one may use an envelope. However, most of the envelopes available on the market today are not resealable.

Additionally, the resealable envelopes the prior art does provide suffer a number of disadvantages. Some of these envelopes have relatively complex fastening devices which include cords or elastic fasteners requiring the use of stiff and bulky materials for the envelope body. Their manufacture is difficult and costly.

Other prior resealable envelopes use adhesive to provide a seal. U.S. Pat. No. 3,070,280 issued Dec. 25, 1962 to Richmond discloses such a resealable envelope. Richmond discloses an envelope with an adhesive seal between the paper closure flap and the paper wall which the flap engages to close the envelope. As an alternative, Richmond discloses an envelope or container having a foil lining and an adhesive seal between the lining and the wall of the container. In this alternative, the adhesive lies between the foil and the paper wall of the envelope. However, when used with paper, the adhesive does not readily release the flap from the wall.

U.S. Pat. No. 3,151,803 issued Oct. 6, 1964 to Kaminski discloses a reusable mailing device. This device or envelope requires the use of a removable sealing strip which the user may easily lose. In addition, the Kaminski envelope has a complex wall construction which does not allow easy resealing or access to its inner pocket.

The resealable envelope of the present invention avoids the shortcomings of the prior resealable envelopes. It is simple and durable in construction and attractive in appearance. It may function as a business report form as well as a storage enclosure for supporting documents associated with the report. It also affords easy and convenient access for the supporting documents.

SUMMARY OF THE INVENTION

Thus, it is an object of this invention to provide an improved resealable envelope which has a simple and inexpensive construction.

It is another object of the present invention to provide an envelope which allows storage of various documents and which also functions as a blank business form or report.

It is yet another object of this invention to provide a resealable envelope which defines a pocket and which allows easy and convenient access to that pocket.

Other objects, advantages, and features of the present invention will become apparent upon reading the following detailed description and appended claims and upon reference to the accompanying drawings.

The resealable envelope of the present invention achieves the foregoing objects. This envelope includes two paper panels disposed in face-to-face relation with one panel having an extending portion to provide a sealing flap. A permanent sealing means secures the panels together along their bottom and side edges, leaving an opening at the top adjacent the flap. Alternatively, the envelope may comprise a paper blank, folded to form two panels and a flap.

For closing the opening between the two panels, the envelope includes a seal comprising: a first plastic strip fixedly secured to the inner face of the closing flap; a second plastic strip fixedly secured to the outer surface of the panel which the flap engages to close the envelope; and a pressure sensitive contact adhesive disposed between the two plastic strips for releasably securing the flap in the closed position.

A removable tape disposed on one of the two plastic strips provides a pressure sensitive contact adhesive for the seal. The adhesive provided by the tape lies between the tape and the plastic strip, and it releasably secures the tape to that strip. It remains on the strip upon removal of the tape and seals the envelope by contacting the other strip when the user closes the flap, placing the two strips in registration and engagement. The adhesive secures the two plastic strips together, thus, closing the envelope. However, when the user pulls the flap away, the adhesive releases from one of the plastic strips and remains on the other strip until resealing.

To construct this envelope, the manufacturer advances a first web of paper and a second paper web having a greater width along the same direction and secures a first continuous plastic strip on the first web and a second continuous plastic strip on the extended portion of the second web. The maker then releasably secures a tape with a transfer adhesive on one of the strips, slits the two webs, and secures them together to form an envelope.

BRIEF DESCRIPTION OF THE DRAWINGS

For a more complete understanding of this invention one should now refer to the embodiments illustrated in greater detail in the accompanying drawings and described below by way of examples of the invention. In the drawings:

FIG. 1 is a front perspective view of one embodiment of the resealable envelope of the present invention.

FIG. 2 is a back perspective view of the resealable envelope of FIG. 1.

FIG. 3 is a partial perspective view of the closure flap of the resealable envelope, showing the flap folded over to seal the envelope.

FIG. 4 is a sectional view taken along line 4—4 in FIG. 3.

FIG. 5 is a sectional view taken along line 5—5 in FIG. 2.

FIG. 6 is a perspective view of a second embodiment of the resealable envelope of the present invention.

While the following text describes the invention in connection with a preferred embodiment and an alternative embodiment, one should understand that the invention is not limited to these embodiments. Furthermore, one should understand that the drawings are not necessarily to scale.

DETAILED DESCRIPTION OF THE DRAWINGS AND THE PREFERRED EMBODIMENTS

Turning now to the drawings, FIGS. 1 and 2 show the preferred embodiment of the invention at 10. The envelope comprises a first wall panel 11; a second wall panel 13 disposed in face-to-face relation with the panel 11 and having an extended segment 15 which is the closure flap for the envelope; a first strip 17 fixedly secured to the first wall panel 11; a second strip 19 fixedly secured to the closure flap 15; and a transfer tape 21 releasably secured to one of the two strips.

The panels 11 and 13 are thin, generally rectangular sheets of paper which allow the user to write on their surfaces. Thus, these panels or the envelope which they form may serve as a business form. A permanent cement 23 (see FIG. 5) or any other suitable securing means secures the side and bottom edges of these two panels together to form a pocket between them. The top edge 25 of the panel 11 defines the opening of the envelope.

The seal strips 17 and 19 are thin, elongate, and substantially impervious plastic strips. They have a generally rectangular configuration. Materials such as the polymer plastic sold under the name Mylar are suitable for forming these strips. A permanent cement 27 or any other suitable permanent securing means secures the first strip 17 to the first panel 11 at the top of the panel 11 and the second strip 19 to the extended segment or closure flap 15 of the second panel 13. The second strip 19 lies proximate the opening of the envelope 10 and it registers with the first strip 17 when the user folds over the closure flap 15 along a fold line 29 as shown in FIG. 3. FIGS. 2 and 4 show the strips 17 and 19 disposed adjacent the opening of the envelope. The manufacturer, however, may secure these strips, 17 and 19, away from this opening as long as the end portion 31 of the closure flap 15 remains free for the user to grasp and open the envelope.

For maintaining a seal, the envelope 10 includes the tape 21 which provides a pressure sensitive contact adhesive 33. Commercially available tapes which provide such an adhesive include a tape sold under the name LITETAC. The adhesive 27 of this tape 21 secures the tape 21 to the sealing strip 19. However, the maker may alternatively secure the tape 21 to strip 17. When the user pulls the tape 21 away, as shown in FIG. 2, the adhesive 33 remains on the strip 19. After removal of the tape, the user may fold the flap 15 over so that the strip 19 registers with strip 17 and the adhesive contacts the strip 17 to produce a seal between the two strips.

To construct the resealable envelope 10, the maker uses two continuous webs of paper, 11 and 13, the web 13 having a greater width than the web 11. While advancing the webs in a predetermined direction, the manufacturer fixedly secures a continuous plastic strip 17 to the web 11 and continuous plastic strip to the web 13 and releasably secures a continuous tape 21 to the strip 19. Then, by slitting the two webs to form panels and securing them together along their edges as described in the above text, the maker may form the envelope. The maker may then print the outer surfaces of this envelope to provide a business form.

FIG. 6 illustrates another embodiment of the resealable envelope of the present invention at 110. This envelope 110 comprises a one-piece blank of lightweight paper 111 folded to form a first panel 113, a second panel 115, and a closure flap 117. A plastic strip 119 fixedly secured to the inner surface of the closure flap 117 and a second plastic strip 121 fixedly secured to the outer surface of the panel 113 register when the user folds the closure flap along fold line 123. A tacky adhesive 125 provided by a tape (not shown) releasably secures the strips 119 and 121 to form the envelope.

To construct the alternative embodiment, the manufacturer may use a continuous web of lightweight paper 111 and advance the paper in a predetermined direction. The maker then fixedly secures the plastic strip 119 on one surface of the web and a second plastic strip 121 to the opposite surface. The maker then applies the tape with the tacky adhesive 125 to strip 119 and, using appropriate apparatus, cuts and folds the web to the configuration shown in FIG. 6.

Thus, the applicant has provided a resealable envelope which meets the aforestated requirements and objects. The envelope is resealable and simple and inexpensive to construct. It includes two panels, a closure flap and a seal comprising two plastic strips, one secured to the closure flap and the other to the panel which the flap contacts to close the envelope, and an adhesive disposed between the two strips to releasably secure them together.

While the applicant has shown and described only a preferred embodiment and one alternative embodiment of the present invention, one will understand, of course, that the invention is not limited to these embodiments since modification of these embodiments and other embodiments will occur to those skilled in the art to which the invention pertains, particularly upon considering the foregoing teachings. For example, those skilled in the art will appreciate that the panels of the envelope may have any one of a variety of shapes, and they may be a one-piece construction or may include segments of paper secured together to form the envelope panels. The applicant, therefore, by the appended claims, intends to cover any modifications and other embodiments that incorporate the essential features of this invention.

I claim:

1. A resealable envelope comprising: a first paper panel including a wall portion and a flap portion; a second paper panel disposed in face-to-face relation with the wall portion of said first panel; a first plastic strip fixedly secured to said flap portion of said first panel; a second plastic strip fixedly secured to said second panel; said first panel being foldable to place said flap portion in overlapping relation with said second panel and said first strip in registration with said second strip; a tape having a pressure sensitive contact adhesive on one face thereof, said adhesive being in contact with one of said strips and releasably securing said tape to said one strip, said adhesive remaining on said one strip upon removal of said tape and effecting sealing of said envelope by contacting the other strip when said strips are brought into registration and pressed against each other.

2. The resealable envelope of claim 1, wherein said first and second panels have a rectangular shape.

3. The resealable envelope of claim 1, wherein said first and second strips are substantially narrow and elongate.

4. The resealable envelope of claim 1, wherein said first and second panels are printable, and each panel provides a writing surface.

5. A resealable envelope comprising: a onepiece foldable blank of paper, said blank having a first end portion and a second opposed end portion; a first plastic strip fixedly secured to said first end portion of said blank of paper; a second plastic strip fixedly secured to said second end portion of said blank of paper; said blank being folded to form a front and a rear wall and to place said end portions in overlapping relation and said first and second strips in registration; a tape having a pressure sensitive contact adhesive on one face thereof, said adhesive being in contact with one of said strips and releasably securing said tape to said one strip, said adhesive remaining on said one strip upon removal of said tape and effecting sealing of said envelope by contacting the other strip when said end portions are brought in overlapping relation, and said first and second strips are in registration and pressed against each other.

* * * * *